US007999163B2

(12) United States Patent
Geoghegan

(10) Patent No.: US 7,999,163 B2
(45) Date of Patent: Aug. 16, 2011

(54) SUPPORT FOR A PIANO LID

(75) Inventor: Daniel E. Geoghegan, Boca Raton, FL (US)

(73) Assignee: Magic Lid, LLC, Pompano Beach, FL (US)

( * ) Notice: Subject to any disclaimer, the term of this patent is extended or adjusted under 35 U.S.C. 154(b) by 134 days.

(21) Appl. No.: 12/503,596

(22) Filed: Jul. 15, 2009

(65) Prior Publication Data

US 2009/0277317 A1 Nov. 12, 2009

Related U.S. Application Data

(63) Continuation-in-part of application No. PCT/US2009/030859, filed on Jan. 13, 2009.

(60) Provisional application No. 61/021,263, filed on Jan. 15, 2008.

(51) Int. Cl.
*G10C 3/02* (2006.01)

(52) U.S. Cl. ..... 84/179

(58) Field of Classification Search ..... 84/7, 79, 84/174, 177–179

See application file for complete search history.

(56) References Cited

U.S. PATENT DOCUMENTS

| | | | |
|---|---|---|---|
| 3,710,954 | A | 1/1973 | Hutchison |
| 3,969,970 | A | 7/1976 | Swift et al. |
| D277,764 | S | 2/1985 | Henkle |
| 6,055,779 | A | 5/2000 | Yang |
| 6,469,237 | B1 | 10/2002 | Arimori |
| 6,506,966 | B2 | 1/2003 | Miura |
| 6,545,203 | B2 | 4/2003 | Arimori |
| 6,946,591 | B2 | 9/2005 | Lee |
| 7,140,588 | B2 | 11/2006 | Shirayanagi et al. |
| 7,155,777 | B2 | 1/2007 | Connors et al. |
| 2005/0092891 | A1 | 5/2005 | Shirayanagi et al. |
| 2006/0000056 | A1 | 1/2006 | Connors et al. |

FOREIGN PATENT DOCUMENTS

| | | |
|---|---|---|
| EP | 1361390 | 11/2003 |
| JP | 09-146534 | 6/1997 |
| JP | 11-231861 | 8/1999 |
| JP | 11-272262 | 10/1999 |
| JP | 11-305761 | 11/1999 |
| JP | 11305761 A * | 11/1999 |

OTHER PUBLICATIONS

Written Opinion of the International Searching Authority in related international application No. PCT/US2009/030859 mailed Jun. 15, 2009 (8 pages).

Written Opinion of the International Preliminary Examining Authority in related international application No. PCT/US2009/030859 mailed Jul. 29, 2010 (5 pages).

* cited by examiner

*Primary Examiner* — Kimberly Lockett

(74) *Attorney, Agent, or Firm* — Margaret Polson; Abigail Smith; Oppedahl Patent Law Firm LLC

(57) ABSTRACT

A mechanism for supporting the weight of a piano lid is disclosed. One or more pneumatic cylinders and arms are used to assist a user in opening and closing the piano lid. In one embodiment, a guiding cup can be removably attached to the frame of the piano below each pneumatic cylinder. When the piano lid is open, the piston arm of the pneumatic cylinder engages the guiding cup. Because the pneumatic cylinder is not attached to the piano frame, the piano lid can be completely removed without the use of tools. Another embodiment provides a mounting bracket that fits over the rear frame of a piano, allowing the mechanism to be retrofit to any existing piano without any damage thereto.

21 Claims, 6 Drawing Sheets

SUPPORT FOR A PIANO LID

CROSS REFERENCE APPLICATIONS

This application claims the benefits of provisional application No. 61/021,263 filed Jan. 15, 2008 and is a continuation-in-part of international application PCT/US2009/030859 filed Jan. 13, 2009, each of which is hereby incorporated herein by reference for all purposes.

FIELD OF INVENTION

The present invention relates to a mechanism and method for assisting users in lifting and supporting a piano lid. More specifically, it consists of a mechanism which uses at least one pneumatic cylinder to assist a user in opening and closing a piano lid.

BACKGROUND

It is often necessary to open the lid of a piano and hold it open. Hinges and braces have been used to open a piano lid and support its weight for some time. Several difficulties exist in opening a piano lid, keeping it open, and eventually closing it. The piano lid is very heavy and can be difficult to raise. Once the lid is raised, it can be difficult to place the end of the brace into the receiving mechanism. Many braces can be easily knocked out of place, causing the lid to drop. When the heavy lid is closed, it can easily overcome the user's strength and fall too quickly, potentially injuring either the user or the piano. Additionally, traditional hinges and braces do not allow a user to bring a piano lid to rest anywhere between an open and closed position.

The foregoing example of the related art and limitations related therewith are intended to be illustrative and not exclusive. Other limitations of the related art will become apparent to those of skill in the art upon a reading of the specification and a study of the drawings.

SUMMARY

An aspect of the invention is to assist the user in opening a piano lid.

Another aspect of the invention is to damp the closing motion of a piano lid.

A further aspect of the invention is to stop a piano lid at any point between open and closed.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

One embodiment discloses a pneumatic cylinder attached to the frame of a piano. An arm is pivotally attached to the lid of the piano. The pneumatic cylinder and arm are connected. The disclosed embodiment has one arm and one pneumatic cylinder. More arms and cylinders are possible. The pneumatic cylinder and arm can be retrofit to a piano.

Another embodiment discloses an internal brace attached to the frame of the piano. An arm is removably attached to the lid of the piano. The brace has two pneumatic cylinders removably attached to it. The brace and cylinders are pivotally attached to the arm. More arms and cylinders are possible. The pneumatic cylinder and arm can be retrofit to a piano.

A further embodiment discloses two arms removably attached to the lid of a piano. Each arm is attached to a pneumatic cylinder. A guiding cup is removably attached to the frame of the piano below each arm and pneumatic cylinder. When the piano lid is closed, the base of the pneumatic cylinder engages the guiding cup. More arms and pneumatic cylinders are possible. Because the pneumatic cylinder is not attached to the piano frame, the piano lid can be completely removed without the use of tools.

Another embodiment discloses an arm removably attached to a housing. The housing is removably attached to a mounting bracket. The arm is attached to a pair of pneumatic cylinders. Guiding cups are mounted in the housing below each arm and pneumatic cylinder. When the piano lid is closed, the base of the pneumatic cylinder engages the guiding cup. The mounting bracket can be placed over the rear frame of the piano without any modification to the piano.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

Figure 1:
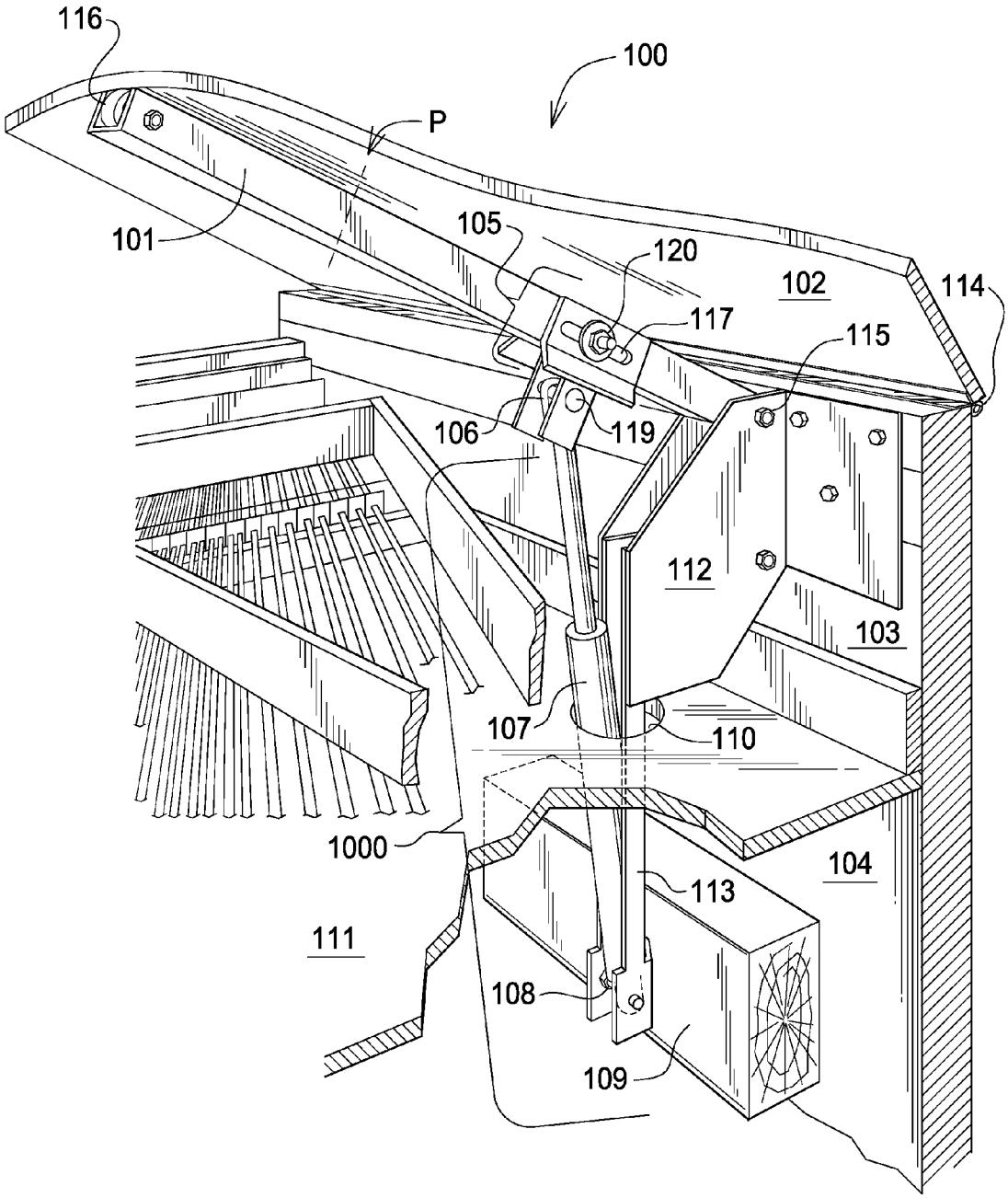
FIG. 1 is a side perspective view of an embodiment of a mechanism for supporting the weight of a piano lid.

Referring first to FIG. 1 a piano 100 includes a lid support 1000 and has an arm 101 attached to the underside of the lid 102. The lid 102 is attached to the rear frame 104 of the piano 100 by hinge 114. The lid 102 is shown in the open position. Arm 101 is approximately 40 inches long, approximately 1 inch wide and approximately 1 inch high. Alternatively, arm 101 can end at point P, which represents the center of gravity of the lid 102. Extending arm 101 beyond point P reduces stress on hinge 114. In the depicted embodiment, arm 101 is 16 gauge mild steel. While 16 gauge mild steel is depicted, any material of similar strength and rigidity, including, but not limited to metals, plastics and ceramics, could be used. Roller 116 rolls on the interior portion of a second end of arm 101. In the depicted embodiment, roller 116 is approximately 15 mm in diameter and 20 mm in width and is nylon. While a nylon roller is depicted, a roller made of any material of similar strength and rigidity could be used. Roller 116 protrudes from the second end of arm 101 approximately 1-2 mm and contacts lid 102. No special treatment of the underside of lid 102 is required. Arm 101 is substantially parallel to the underside of lid 102 when lid 102 is in a closed position. As lid 102 is rotated from a closed to an open position, the second end of arm 101 traverses the underside of piano lid 102 and the angle α (depicted in FIG. 2) between the second end of arm 101 and piano lid 102 increases to a range of approximately 1-3 degrees.

A first end of arm 101 is attached at pivot point 115 to mounting bracket 112. Mounting bracket 112 has a leg 113 that extends downward through a hole 110 in the sounding board 111. In the depicted embodiment, mounting bracket 112 is 1"×1" angle, mild steel. While 1"×1" angle, mild steel is depicted, any material of similar strength and rigidity, including, but not limited to metals, plastics and ceramics, could be used. Hole 110 has an approximate diameter of 2 inches. Mounting bracket 112 is attached to the upper interior portion 103 of rear frame 104. The top of mounting bracket 112 is substantially coplanar with hinge 114. The joint of hinge 114 is located on the opposing side of rear frame 104 from mounting bracket 112.

An adjustable pivotal connector 105 is removably attached to arm 101 at a distance determined by the equation $W=(X\cdot F)/L$, where W=the weight to lift, X=the distance from the center of pivot point 119 to the center of pivot point 115, L=the distance from roller 116 to pivot point 115 and F=the force needed in pneumatic cylinder 107 to lift the weight of lid 102. Bolt 120 is slideable within slot 117 to adjust pivotal connector 105. The piston arm 106 of a pneumatic cylinder 107 is removably attached to the adjustable pivotal connector 105 at pivot point 119. The lower portion 108 of the pneumatic cylinder 107 is pivotally attached to the leg 113 of mounting bracket 112. Leg 113 is connected to the lower interior portion 109 of the rear frame 104 of piano 100. For the purposes of this application, the rear frame of piano 100 refers to the side on which the hinge for the piano lid is located.

Figure 3:
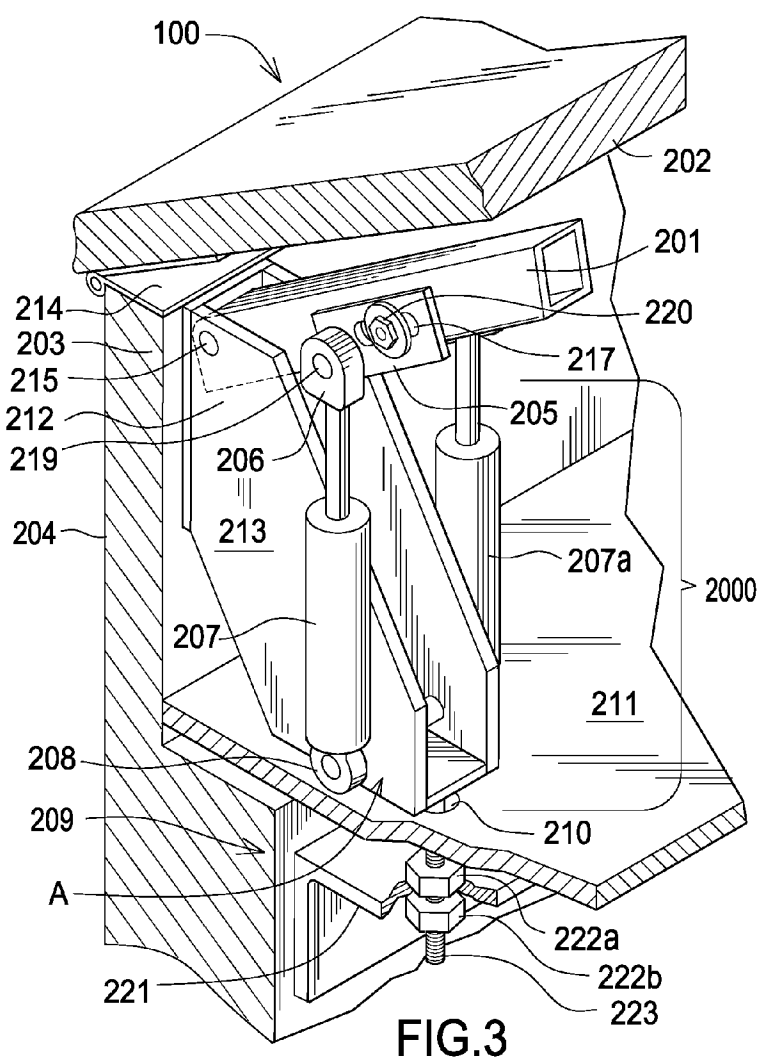
FIG. 3 is a perspective view of the embodiment shown in FIG. 2.
Figure 2:
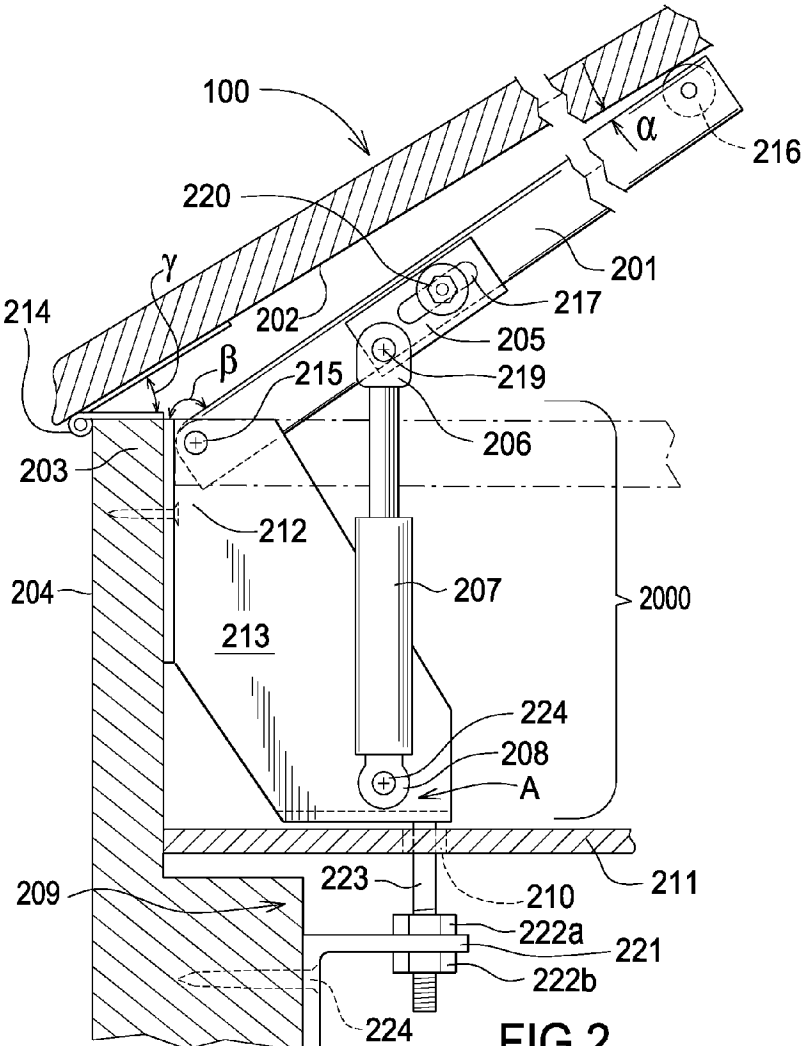
FIG. 2 is a longitudinal sectional view of a second embodiment of a mechanism for supporting the weight of a piano lid.

Once lid support 1000 is installed, piano lid 102 can be opened and closed with ease. Additionally, piano lid 102 can now be stopped at any point between open and closed. A user can open, close or stop the lid with as little as one half Newton of force, the equivalent of the force exerted by a single finger. In the disclosed embodiment pneumatic cylinder 107 can be a range of sizes exerting between approximately 50 Newtons of force to approximately 1,300 Newtons of force. In the depicted embodiment, pneumatic cylinder 107 has an extended length of 7½ inches, a diameter of 1 inch, a ⅜ inch cylinder rod, a 2 inch stroke and exerts 1,000 Newtons of force. As shown in FIGS. 2 and 3, a second embodiment, lid support 2000, a mechanism for supporting weight of piano lid is shown. Lid 202 is attached to the rear frame 204 of piano 100 by hinge 214. For the purposes of this application, the rear frame of piano 100 refers to the side on which the hinge for the piano lid is located. Lid 202 is shown in the open position. An arm 201 rolls on the underside of the lid 202. No special treatment of the underside of lid 202 is required. A first end of arm 201 is attached to the rear upper portion 212 of a bracket 213 at pivot point 215. Bracket 213 is attached to the upper interior portion 203 of the rear frame 204 of piano 100 and the sounding board 211. The top of bracket 213 is substantially coplanar with hinge 214. The joint of the hinge 214 is located on the opposing side of rear frame 204 from bracket 213. In the depicted embodiment, bracket 213 is made from 1"×1" square tube, 16 gauge mild steel. While 1"×1" square tube, 16 gauge mild steel is depicted, any material of similar strength and rigidity, including, but not limited to metals, plastics and ceramics, could be used.

Arm 201 is approximately 40 inches long, approximately 1 inch wide and approximately 1 inch high. Alternatively, arm 201 can end at the center of gravity of lid 202. Extending arm 201 beyond the center of gravity of lid 202 reduces stress on hinge 214. In the depicted embodiment, arm 201 is made from 16 gauge mild steel. While 16 gauge mild steel is depicted, any material of similar strength and rigidity, including, but not limited to metals, plastics and ceramics, could be used. Roller 216 is attached to the interior portion of a second end of arm 201. In the depicted embodiment, roller 216 is approximately 15 mm in diameter, 20 mm in width and is nylon. While a nylon roller is depicted, a roller made of any material of similar strength and rigidity could be used. Roller 216 protrudes from the second end of arm 201 approximately 1-2 mm and contacts lid 202. Arm 201 is substantially parallel to the underside of lid 202 when lid 202 is in a closed position. As lid 202 is rotated from a closed to an open position, the angle represented by α increases from approximately 0 degrees to approximately 1-3 degrees, the angle represented by β increases to approximately 132-150 degrees and the angle represented by γ increases to approximately 32-45 degrees.

Adjustable pivotal connector 205 is removably attached to opposing sides of the arm 201 at a distance determined by the equation $W=(X\cdot F)/L$, where W=the weight to lift, X=the distance from the center of pivot point 219 to the center of pivot point 215, L=the distance from roller 216 to pivot point 215 and F=the force needed in pneumatic cylinders 207, **207*a* to lift the weight of lid 202. Bolt 220 is slideable within slot 217 to adjust pivotal connector 205. The piston arms 206 of pneumatic cylinders 207, 207*a* are removably attached to adjustable pivotal connector 205 at pivot point 219. The lower portion 208 of pneumatic cylinders 207, 207*a* are removably attached to opposing sides of area A of the bracket 213 at pivot point 224**.

Optionally, a leg 223 can be attached to the lower portion of bracket 213 to provide structural support. Leg 223 extends through a hole 210 in the sounding board 211 and is removably attached to bracket 221 with nuts **222*a*, 222*b*. In the depicted embodiment, hole 210 has an approximate diameter of ½ inch. Bracket 221 is attached to the lower portion 209 of the rear frame 204 of piano 100 with bolt 224**.

Once lid support 2000 is installed, piano lid 202 can be opened and closed with ease. Additionally, piano lid 202 can now be stopped at any point between open and closed. A user can open, close or stop the lid with as little as one half Newton of force, the equivalent of the force exerted by a single finger.

In the disclosed embodiment pneumatic cylinder 207 can be a range of sizes exerting between approximately 50 Newtons of force to approximately 1,300 Newtons of force. In the depicted embodiment, pneumatic cylinder 207 has an extended length of 7½ inches, a diameter of 1 inch, a ⅜ inch cylinder rod, a 2 inch stroke and exerts 1,000 Newtons of force.

Figure 4:
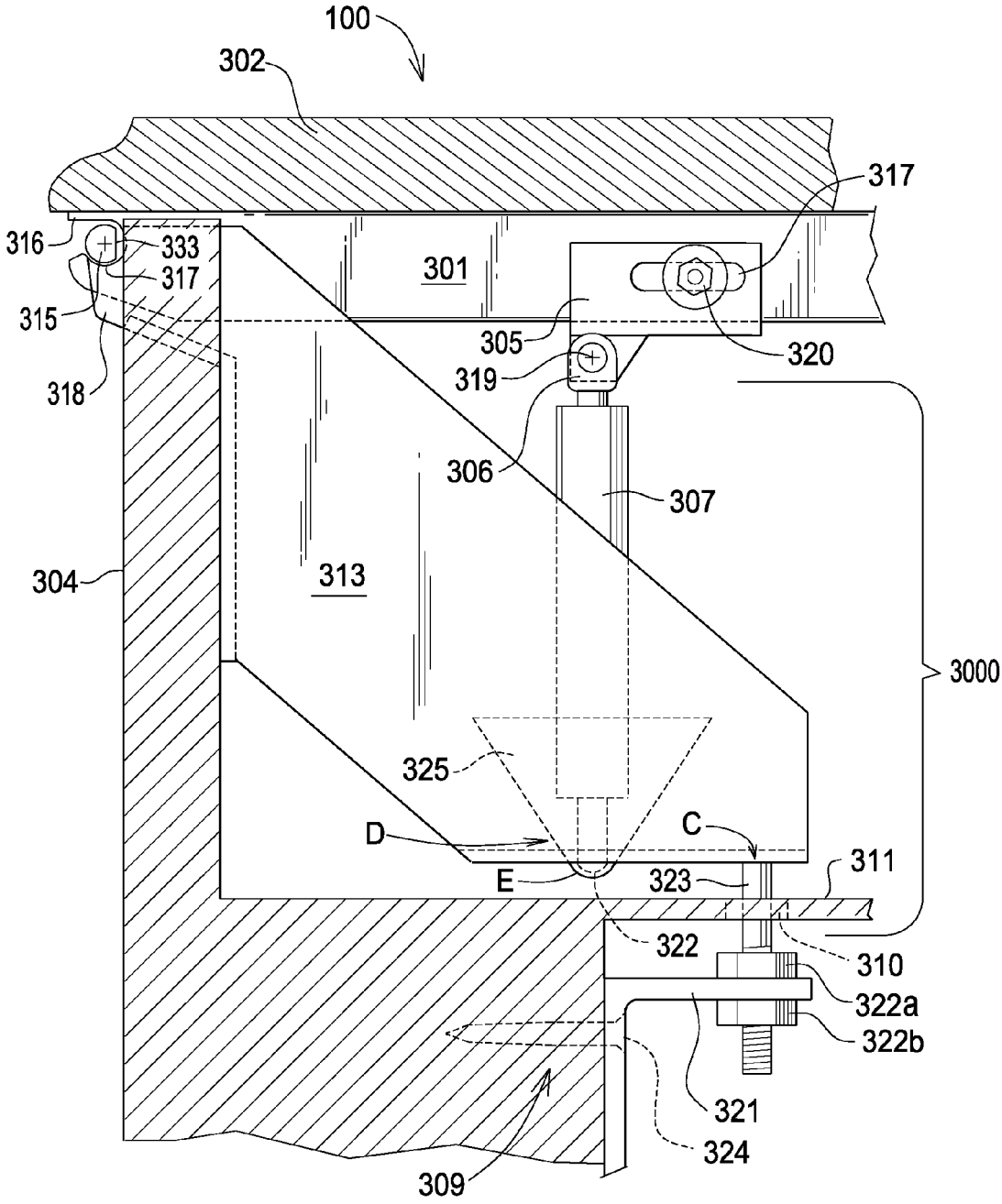
FIG. 4 is a longitudinal sectional view of a third embodiment of a mechanism for supporting the weight of a piano lid.
Figure 6:
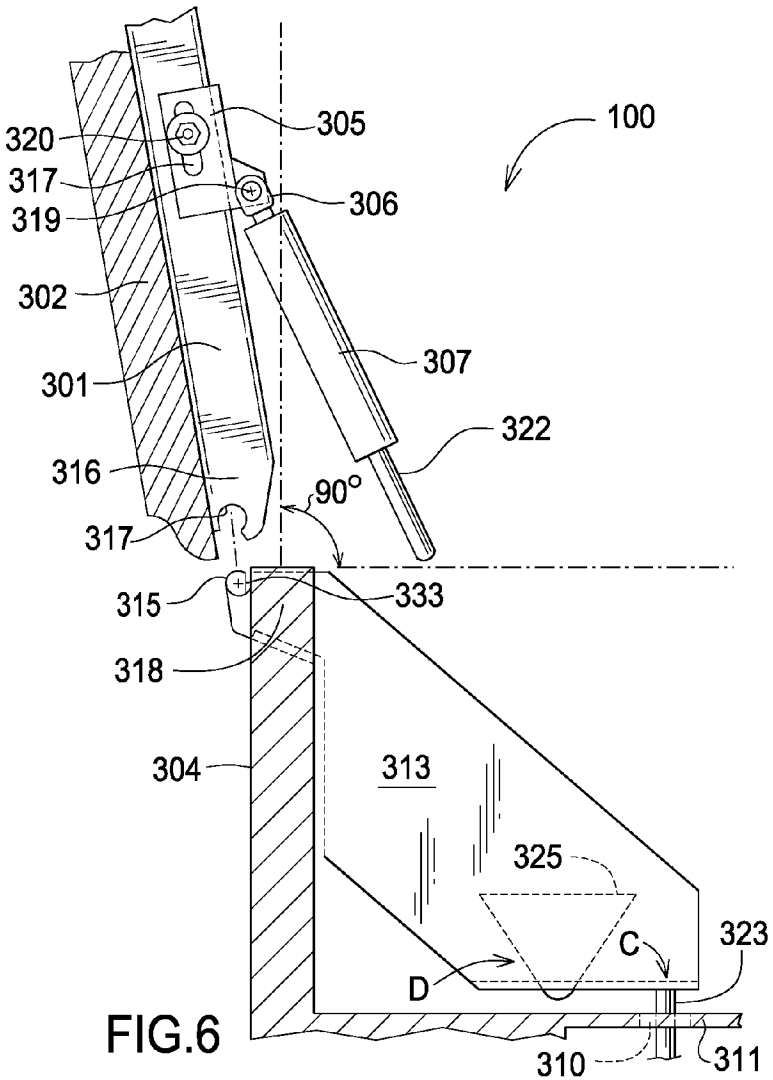
FIG. 6 is a similar view of the embodiment shown in FIG. 4 with the lid lifted more than 90° open and separated from the piano.
Figure 5:
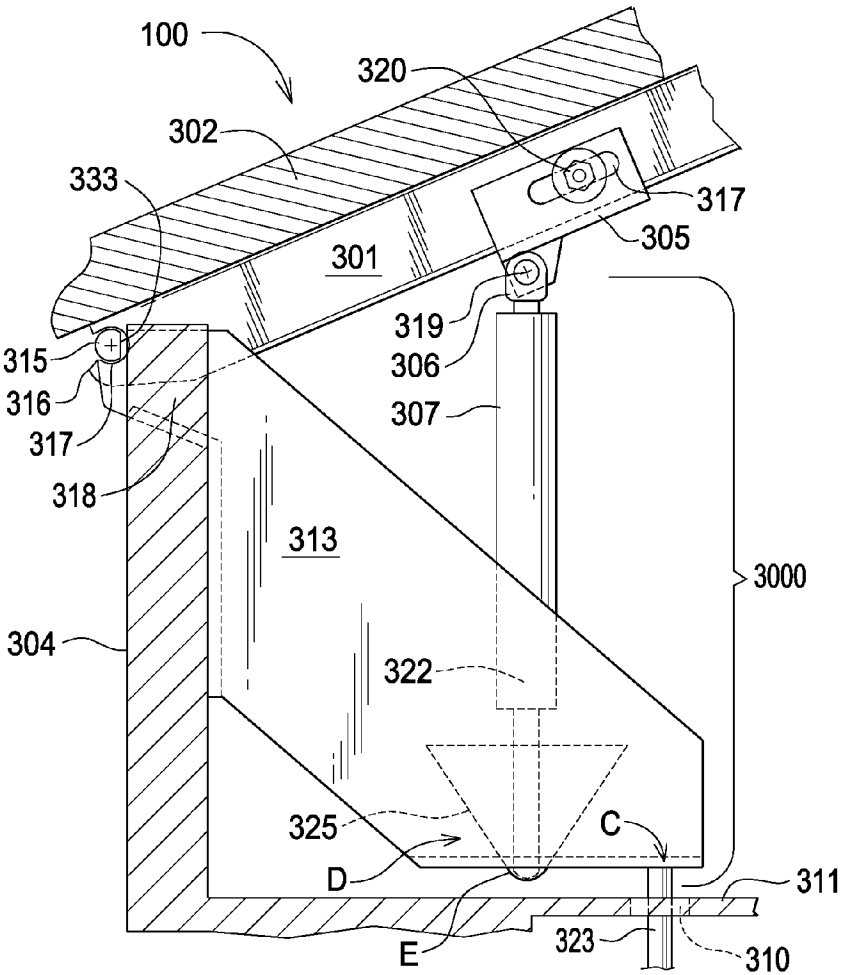
FIG. 5 is a similar view of the embodiment shown in FIG. 4 with the lid partially open.

As shown in FIGS. 4, 5 and 6, a third embodiment, lid support 3000, a mechanism for supporting the weight of piano lid 302, has an arm 301 attached to the underside of the lid 302 of piano 100. A first end 316 of arm 301 has a recessed opening 317. Arm 301 is approximately 40 inches long, approximately 1 inch wide and approximately 1 inch high. Alternatively, arm 301 can end at the center of gravity of the lid 302. In the depicted embodiment, arm 301 is 16 gauge mild steel. While 16 gauge mild steel is depicted, any material of similar strength and rigidity, including, but not limited to metals, plastics and ceramics, could be used.

Adjustable pivotal connector 305 is removably attached to opposing sides of arm 301 at a distance determined by the equation W=(X·F)/L, where W=the weight to lift, X=the distance from the center of pivot point 319 to the center of pin 315, L=the distance from the second end of arm 301 to pin 315 and F=the force needed in pneumatic cylinder 307 to lift the weight of lid 302. Bolt 320 is slideable within slot 317 to adjust pivotal connector 305.

The piston arm 306 of a pneumatic cylinder 307 is attached to adjustable pivotal connector 305 at pivot point 319. The upper portion 318 of a bracket 313 is attached to the upper portion of the rear frame 304 of piano 100. A guiding cup 321 is attached to area D of bracket 313. Area D is approximately one third of the distance total depth of bracket 313 from the frontal portion of bracket 313. Guiding cup 325 is conical in shape. The base E of guiding cup 325 is just large enough to accept the piston arm 322 of pneumatic cylinder 307. When lid 302 is closed, gravity will pull piston arm 322 into guiding cup 321. The conical shape of guiding cup 325 will cause the piston arm 322 of pneumatic cylinder 307 to rest in the base E of guiding cup 325.

In the depicted embodiment, bracket 313 is made from 1"×1" square tube, 16 gauge mild steel. While 1"×1" square tube, 16 gauge mild steel is depicted, any material of similar strength and rigidity, including, but not limited to metals, plastics and ceramics, could be used. In the depicted embodiment, pneumatic cylinder 307 can be a range of sizes exerting between approximately 50 Newtons of force and approximately 1,300 Newtons of force. In the depicted embodiment, the cylinder has an extended length of 7½ inches, a diameter of 1 inch, a ⅜ inch cylinder rod, a 2 inch stroke and exerts 1,000 Newtons of force.

The interaction of the upper portion 318 of bracket 313 and recessed opening 317 of arm 301 acts as a hinge to attach lid 302 to the rear frame 304 of piano 100. A pin 315 is inserted in recessed opening 317 and acts as a joint for the created hinge. The interior portion 333 of pin 315 is missing a portion of its circumference. In the depicted embodiment, pin 315 is approximately 2½ long. The missing portion of the circumference of the interior portion 333 of pin 315 and the size of recessed opening 317 are proportionate. Recessed opening 317 of arm 301 extends greater than 180 degrees around the circumference of pin 315. Thus, lid 302 must be lifted beyond 90 degrees (see dotted line of 90 degrees marked "90°" in FIG. 6) in order to remove the lid 302 from piano 100. Once lid 302 is lifted beyond approximately 90 degrees, the missing portion of the circumference of the interior portion 333 of pin 315 allows lid 302 to be completely removed from piano 100. Extending arm 301 beyond the center of gravity of lid 302 reduces stress on the upper portion 318 of bracket 313 and recessed opening 317 of arm 301, which act as the hinge to attach lid 302 to piano 100.

Optionally, a leg 323 can be attached to the lower portion of bracket 313 to provide structural support. Leg 323 extends through a hole 310 in the sounding board 311 and is removably attached to bracket 321 with nuts 322*a*, 322*b*. Hole 310 has an approximate diameter of ½ inch. Bracket 321 is attached to the lower portion 309 of the rear frame 304 of the piano 100 with bolt 324. For the purposes of this application, the rear frame of piano 100 refers to the side on which the hinge for the piano lid is located.

The disclosed third embodiment 3000 has an arm assembly on the opposite side of the piano that is a mirror image of that disclosed in FIGS. 4, 5 and 6.

Once lid support 3000 is installed, piano lid 302 can be opened and closed with ease. Additionally, piano lid 302 can now be stopped at any point between open and closed. A user can open, close or stop the lid with as little as one half Newton of force, the equivalent of the force exerted by a single finger.

FIG. 4 shows the lid 302 in the closed position.

FIG. 5 shows the lid 302 raised from the closed position. FIG. 6 shows the lid 302 completely removed from the piano.

Figure 8:
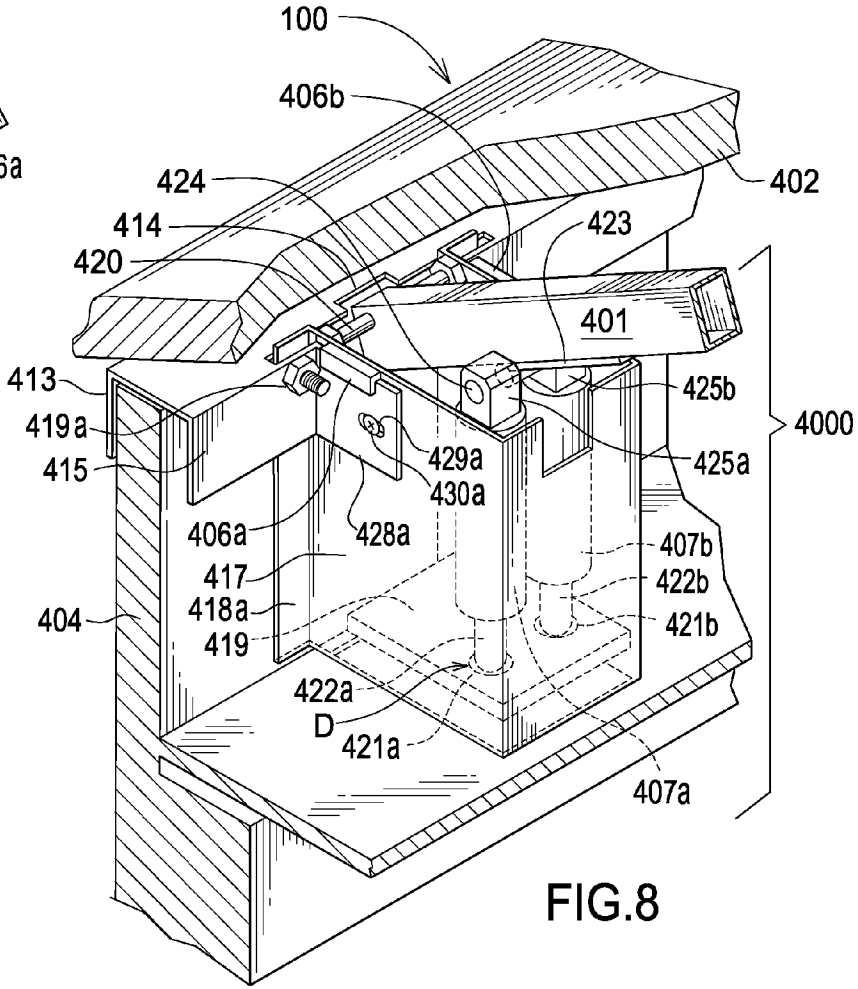
FIG. 8 is a perspective view of the embodiment shown in FIG. 7.
Figure 7:
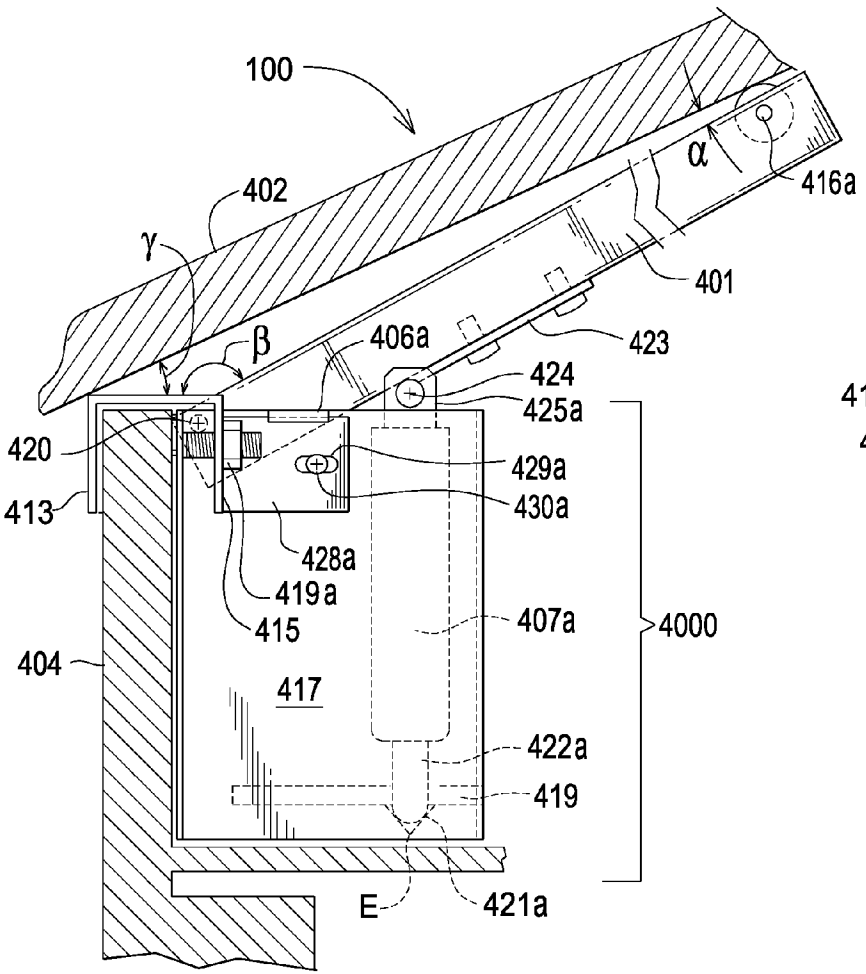
FIG. 7 is a longitudinal sectional view of a fourth embodiment of a mechanism for supporting the weight of a piano lid.

As shown in FIGS. 7 and 8, a fourth embodiment, lid support 4000, a mechanism for supporting the weight of piano lid 402, has a mounting bracket 413 placed over the rear frame 404 of the piano 100. For the purposes of this application, the rear frame of piano 100 refers to the side on which the hinge for the piano lid is located. In the depicted embodiment, bracket 413 is 16 gauge mild steel sheet metal. While 16 gauge mild steel sheet metal is depicted, any material of similar strength and rigidity, including, but not limited to metals, plastics and ceramics, could be used. The internal surface of mounting bracket 413 is coated with felt so as not to scratch the surface of the piano. While felt is the preferred material, any material that would prevent scratching could be used. Mounting bracket 413 has a recessed portion 414 in the approximate center of its front face 415. Mounting bracket 413 has holes (not shown) on either side of recessed portion 414. Connector 428*a* extends generally perpendicular to front face 415 of mounting bracket 413. Connector 428*a* includes slots 429*a*. A mirror image connector extends from the other side of mounting bracket 413 and is not shown. The top of mounting bracket 413 is substantially coplanar with the hinge connecting lid 402 to the rear frame 404 of piano 100. The joint of the hinge connecting lid 402 to the rear frame 404 of piano 100 is located on the opposing side of rear frame 1404 from front face 415 of mounting bracket 413. In the disclosed embodiment, mounting bracket 413 is approximately 10 inches long, approximately 1.25 inches high and approximately 1.5-2 inches wide. In the disclosed embodiment, recessed portion 414 of mounting bracket 413 is approximately 2.5 inches long.

A housing 417 is attached to mounting bracket 413. In the depicted embodiment, housing 417 is 16 gauge mild steel sheet metal. While 16 gauge mild steel sheet metal is depicted, any material of similar strength and rigidity, including, but not limited to metals, plastics and ceramics, could be used. Housing 417 has a width approximately equal to that of the recessed portion of mounting bracket 413. In the disclosed embodiment, housing 417 has a length of approximately 4 inches, a height of approximately 5.5 inches, and a width of approximately 2.5 inches. Housing 417 has extension 418*a*. In the disclosed embodiment, extension 418*a* has a width of 0.75 inches. Extension 418*a* extends behind front face 415 of mounting bracket 413 and is attached thereto via screw 419*a*. In the disclosed embodiment screw 419*a* is a socket head bolt 5/16"-18×¾". The rear face of extension 418*a* is coated with felt. While felt is the preferred material, any material that would prevent scratching could be used. Housing 417 has a mirror image extension on its other side, which is not shown. Screw 430*a* further attaches housing 417 to mounting bracket 413. Screw 430*a* is slideable within slot 429*a*. In use, the interaction of screw 430*a* and slot 429*a* functions to prevent connector 428*a* and housing 417 from moving when bolt 419*a* is tightened. Bracket 406*a* also functions to prevent connector 428*a* and housing 417 from moving when bolt 419*a* is tightened. Screw 430*a*, slot 429*a* and bracket 406*a* can all be used together. Alternatively, a user may choose to use either screw 430*a* and slot 429*a* or bracket 406*a*. It should be understood that any method that can prevent connector 428*a* and housing 417 from moving when bolt 419*a* is tightened may also be used. The base 419 of housing 417 has guiding cups 421*a*, 421*b* in area D. Area D is approximately one third of the distance from the frontal portion of housing 417. Guiding cups 421*a*, 421*b* are conical in shape.

An arm 401 is attached to housing 417 via a pin 420. Pin 420 transverses a first end of arm 401 and mounts in housing 417. In the disclosed embodiment pin 420 has a diameter of approximately ⅜". A second end of arm 401 rolls on the underside of lid 402 via roller 416. No special treatment of the underside of lid 402 is required. Roller 416 is attached to the interior portion of the second end of arm 402. Arm 401 is substantially parallel to the underside of lid 402 when lid 402 is in a closed position. As lid 402 is rotated from a closed to an open position, the second end of arm 401 traverses the underside of piano lid 402 and the angle represented by a increases from approximately 0 degrees to approximately 1-3 degrees, the angle represented by β increases to approximately 132-150 degrees and the angle represented by y increases to approximately 32-45 degrees.

Arm 401 is approximately 40 inches long, approximately 1 inch wide and approximately 1 inch high. In the depicted embodiment, arm 401 is 16 gauge mild steel. Alternatively, arm 401 can end at the center of gravity of the lid 402. Extending arm 401 beyond the center of gravity of lid 402 reduces stress on the existing hinges. In the depicted embodiment, roller 416 is approximately 15 mm in diameter, 20 mm in width and is nylon. While a nylon roller is depicted, a roller made of any material of similar strength and rigidity could be used. Roller 416 protrudes from the second end of arm 401 approximately 1-2 mm and contacts lid 402.

Bracket 423 is removably attached to the underside of arm 401. A pin 424 is attached to bracket 423. Pneumatic cylinders 407*a*, 407*b* are attached via eyelets 425*a*, 425*b* to either side of pin 424. In the disclosed embodiment pin 424 and eyelets 425*a*, 425*b* each have a diameter of approximately ⅜". The location of bracket 423 on arm 401 is determined by the equation W=(X·F)/L, where W=the weight to lift, X=the distance from the center of pin 424 to the center of pin 420, L=the distance from roller 416 to pin 420 and F=the force needed in pneumatic cylinder 407*a*, 407*b* to lift the weight of lid 402.

The base E of guiding cups 421*a*, 421*b* is just large enough to accept the piston arms 422*a*, 422*b* of pneumatic cylinders 407*a*, 407*b*. When lid 402 is closed, gravity will pull piston arms 422*a*, 422*b* into guiding cups 421*a*, 421*b*. The conical shape of guiding cups 421*a*, 421*b* will cause the piston arms 422*a*, 422*b* of pneumatic cylinder 407*a*, 407*b* to rest in the base E of guiding cups 421*a*, 421*b*.

Pneumatic cylinder 407 can be a range of sizes exerting between approximately 50 Newtons of force and approximately 1,300 Newtons of force. In a preferred embodiment, the cylinder has an extended length of 7½ inches, a diameter of 1 inch, a ⅜ inch cylinder rod, a 2 inch stroke and exerts 1,000 Newtons of force.

In use, mounting bracket 413 is placed over the rear frame 404 of a piano 100 at a chosen point between the existing hinges. Screws 419*a*, 419*b* are used to tighten lid support 4000 onto the piano 100. Piano lid 402 can now be opened and closed with ease. Additionally, piano lid 402 can now be stopped at any point between open and closed. A user can open, close or stop the lid with as little as one half Newton of force, the equivalent of the force exerted by a single finger.

Figure 9:
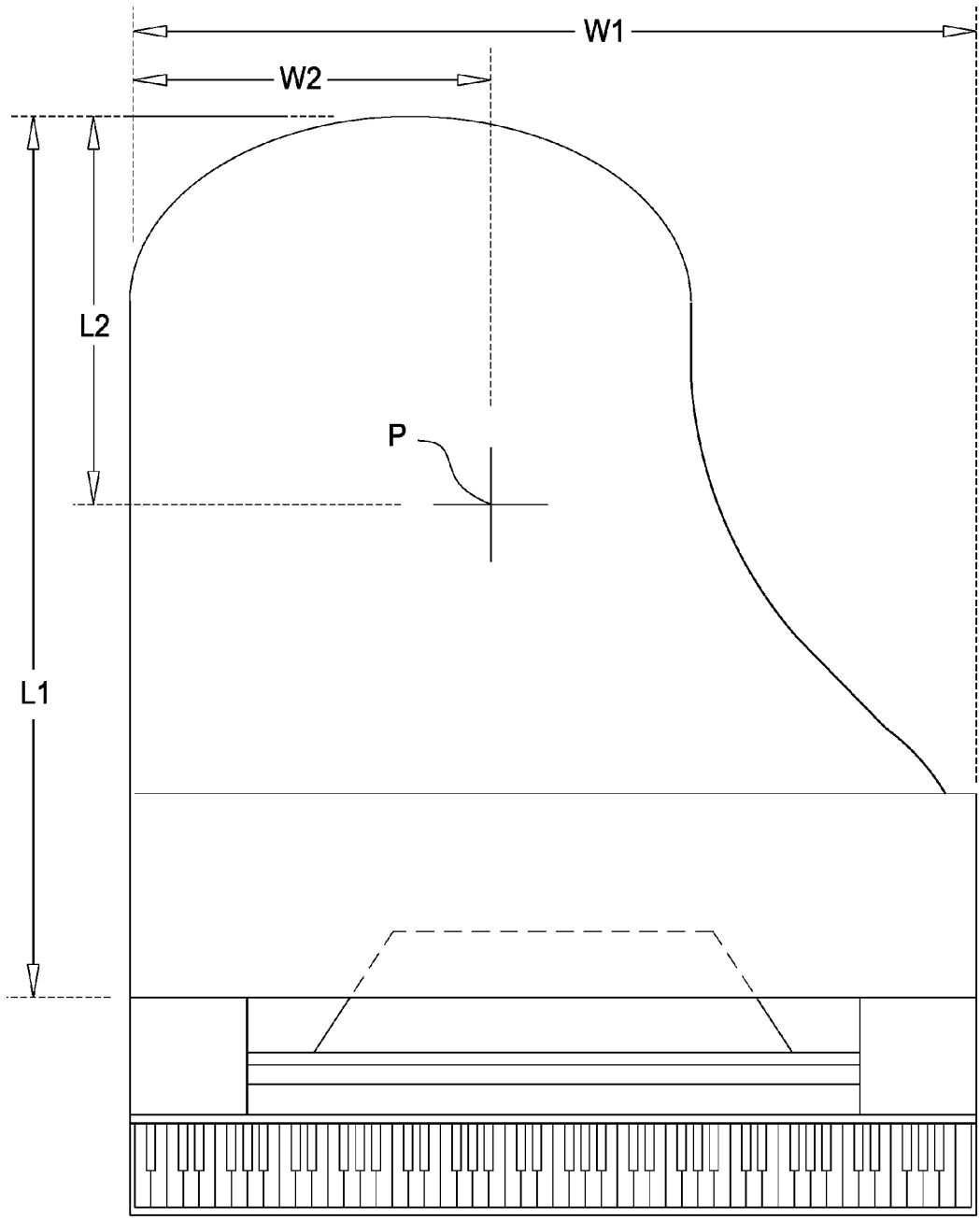
FIG. 9 is a top plan view of a grand piano.

FIG. 9 shows a top plan view of a grand piano. Grand piano lid 502 has a width, measured between W1 and W2, of approximately 150 cm. Grand piano lid 502 has a length, measured between L1 and L2, of between approximately 140 cm and 275 cm, depending on the type of grand piano. Grand piano lid 502 weighs between 21 and 65 pounds, depending on the type of grand piano. The center of gravity P for grand piano lid 502 is located between 55 and 60% of the total length of piano lid 502 when measured from L2 and between 40 and 45% of the total width of piano lid 502 when measured from W1. Variation in the center of gravity is caused by variations in the size and shape of piano lid 502. The lid support of the present invention can be adjusted along the length of the piano 100 during installation to locate the exact center of gravity. The disclosed embodiments of the present invention can be used with a grand piano as disclosed in FIG. 9. A single lid support of the present invention can support a lid of up to approximately 45 pounds having a length of up to approximately 214 cm. Two lid supports of the present invention are utilized to support a lid of greater than approximately 45 pounds having a length of greater than 214 cm.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

I claim:

1. A support for a piano lid comprising:
an arm having a first end and a second end;
said second end in contact with an underside of a piano lid;
said first end pivotally attached to a mounting bracket;
said arm substantially parallel to said underside of a piano lid when said lid is in a closed position;
as said lid is rotated from a closed to an open position the second end of said arm traverses the underside of the piano lid and the angle between said second end of said arm and said lid increases to about 2 degrees;
said mounting bracket attached to the rear frame of a piano; and
a pneumatic cylinder pivotally attached to said arm;
wherein said arm will fully support said piano lid at any chosen open position.

2. The apparatus of claim 1, wherein said mounting bracket further comprises a leg extending below the bracket, said bracket attached to said rear frame below the sounding board.

3. The apparatus as claimed in claim 1 having multiple pneumatic cylinders.

4. The apparatus as claimed in claim 1 wherein the top of the mounting bracket is substantially coplanar with a hinge connecting the piano lid to the rear frame.

5. The apparatus as claimed in claim 1 wherein the joint of a hinge connecting the piano lid to the rear frame is located on the opposing side of the rear frame from the mounting bracket.

6. The apparatus as claimed in claim 1 wherein the angle between the second end of the arm and the lid increases to about 3 degrees as said lid is rotated from a closed to an open position.

7. The apparatus as claimed in claim 1 wherein the angle between the second end of the arm and the lid increases to about 2 degrees as said lid is rotated from a closed to an open position.

8. A support for a piano lid comprising:
arm means for supporting a piano lid;
said arm means having a first end and a second end;

said arm means substantially parallel to said piano lid when said lid is in a closed position;

as said lid is rotated from a closed to an open position the second end of said arm means traverses the underside of the piano lid and the angle between said second end of said arm means and said lid increases to about 2 degrees;

means for connecting said first end of said arm means to said piano;

a portion of said means for connecting substantially coplanar with a hinge connecting said piano lid to a rear frame of a piano;

the joint of said hinge located on the opposing side of said rear frame from said means for connecting;

means for assisting a user in opening a piano lid and dampening the closing motion of said piano lid;

said means for assisting a user in opening a piano lid and dampening the closing motion of said piano lid comprising a pneumatic cylinder; and means for connecting said arm to said means for assisting a user in opening a piano lid and dampening the closing motion of said piano lid.

9. The apparatus of claim 6, wherein said means for connecting comprises a mounting bracket.

10. The apparatus as claimed in claim 8, wherein said means for assisting a user in opening a piano lid and damping the closing motion of said piano lid comprises multiple pneumatic cylinders.

11. The apparatus as claimed in claim 8 wherein the angle between the second end of the arm and the lid increases to about 2 degrees as said lid is rotated from a closed to an open position.

12. The apparatus as claimed in one of claim 8 wherein the angle between the second end of the arm and the lid increases to about 2 degrees as said lid is rotated from a closed to an open position.

13. A support for a piano lid comprising:

an arm attached to the underside of a piano lid;

said arm having a first end and a second end;

said first end having a recessed opening;

a pneumatic cylinder pivotally attached to said arm;

a mounting bracket attached to the rear frame of a piano;

the interaction of said recessed opening and the upper portion of said mounting bracket creating a hinge;

a pin sized to fit into said recessed opening of said arm;

said pin having a portion of the circumference of its interior surface removed;

said pin forming the joint of said hinge;

said recessed opening extending more than 180 degrees around said pin;

wherein rotating said piano lid greater than approximately 90 degrees will allow removal of said lid from said piano.

14. The apparatus of claim 13, wherein said mounting bracket includes a guiding cup.

15. The apparatus as claimed in claim 13, wherein said mounting bracket further comprises a leg extending below the bracket, said bracket attached to said rear frame below a sounding board of said piano.

16. An apparatus for us with a piano, the piano having an upper interior portion of a frame of the piano, the apparatus comprising:

a mounting bracket;

said mounting bracket having a first portion extending parallel to the upper interior portion of a piano frame;

said mounting bracket having a second portion extending downward from said parallel portion on the outside of the piano frame;

said mounting bracket having a third portion extending downward from said parallel portion on the inside of the piano frame;

wherein said mounting bracket fits over said upper interior portion of the piano frame;

an arm having a first end and a second end;

said second end in contact with an underside of the lid of said piano;

said first end pivotally attached to said mounting bracket;

said arm substantially parallel to said underside of a piano lid when said lid is in a closed position;

as said lid is rotated from a closed to an open position the second end of said arm traverses the underside of the piano lid; and a pneumatic cylinder pivotally attached to said arm.

17. A method for supporting a piano lid comprising the steps of:

lowering a mounting bracket over the upper interior portion of a piano frame;

said mounting bracket having a first portion extending parallel to the upper interior portion of a piano frame;

said mounting bracket having a second portion extending downward from said parallel portion;

said mounting bracket having a third portion extending downward from said parallel portion;

whereby said first portion is on top of the upper interior portion of the piano frame;

whereby the second portion is on the outside of the upper interior portion of the piano frame;

the method further comprising pivotally attaching a first end of an arm to the first portion of said mounting bracket;

the method further comprising pivotally attaching a pneumatic cylinder to said arm; and the method further comprising placing the second end of said arm in contact with the piano lid.

18. The method of claim 17 further comprising opening the lid to at least 30 degrees.

19. The method of claim 18 wherein the lid stays open to at least 30 degrees when a user removes his or her hand.

20. The method of claim 17 wherein a user exerts as little as one half Newton of force to open the lid.

21. The apparatus of claim 1, wherein said arm extends to at least the approximate center of gravity of said piano lid.

* * * * *